US005235944A

United States Patent [19]

Adachi

[11] Patent Number: 5,235,944

[45] Date of Patent: Aug. 17, 1993

[54] ENGINE LUBRICATING SYSTEM

[75] Inventor: Yoshihiko Adachi, Iwata, Japan

[73] Assignee: Yamaha Hatsudoki Kabushiki Kaisha, Iwata, Japan

[21] Appl. No.: 892,195

[22] Filed: Jun. 2, 1992

[30] Foreign Application Priority Data

Feb. 15, 1992 [JP] Japan ..... 4-061437

[51] Int. Cl.[5] ..... F01L 1/12

[52] U.S. Cl. ..... 123/196 R; 123/196 W; 184/6; 184/7.4

[58] Field of Search ..... 123/196 R, 196 EP, 196 W, 123/73 AD; 184/7.4, 6

[56] References Cited

U.S. PATENT DOCUMENTS

| | | | |
|---|---|---|---|
| 2,796,075 | 6/1957 | Focht | 137/108 |
| 3,435,612 | 4/1969 | Hensler | 123/196 R |
| 3,447,636 | 6/1969 | Bonfilio | 123/196 R |
| 4,094,293 | 6/1978 | Evans | 123/196 R |
| 4,199,950 | 4/1980 | Hakanson et al. | 123/196 CP |
| 4,286,632 | 9/1981 | Abel | 141/18 |
| 4,452,188 | 6/1984 | Kosuda et al. | 123/196 R |
| 4,480,602 | 11/1984 | Kobayashi et al. | 123/196 R |
| 4,512,298 | 4/1985 | Hayashi | 123/196 R |
| 4,893,598 | 1/1990 | Stasiuk | 123/196 R |
| 5,020,484 | 6/1991 | Ishikawa | 123/196 R |

FOREIGN PATENT DOCUMENTS

| | | | |
|---|---|---|---|
| 949855 | 9/1956 | Fed. Rep. of Germany . | |
| 62-131908 | 6/1987 | Japan . | |
| 1-044711 | 2/1989 | Japan . | |
| 0045912 | 2/1989 | Japan | 123/196 R |
| 192505 | 4/1989 | Japan . | |
| 2-191807 | 7/1990 | Japan . | |
| 2-118110 | 9/1990 | Japan . | |
| 2-118111 | 9/1990 | Japan . | |
| 2-139307 | 11/1990 | Japan . | |

OTHER PUBLICATIONS

European Search Report, Patent Abstracts of Japan vol. 9, No. 231 (M-414) (1954) 18 Sep. 1985 & JP-A-60 88 811 (Sanshin Kogyo K.K.) 18 May 1985 *Abstract*.

*Primary Examiner*—E. Rollins Cross
*Assistant Examiner*—Erick Solis
*Attorney, Agent, or Firm*—Ernest A. Beutler

[57] ABSTRACT

A lubrication system for the internal combustion engine of a motorcycle that includes a pump that outputs a constant amount of fluid per cycle of operation and a delivery valve which selectively passes lubricant to the engine or returns lubricant back to the system to vary the amount of lubricant supplied by the lubricant pump. The system is designed so as to self purge air from the system by mounting the lubricant pump and the delivery valve in close proximity to each other and at a lower level than the lubricant storage tank. In addition, the engine is supplied with arrangement to preclude lubricant from draining into the engine through the delivery valve when the engine is not running.

11 Claims, 5 Drawing Sheets

ENGINE LUBRICATING SYSTEM

BACKGROUND OF THE INVENTION

The invention relates to an engine lubricating system and more particularly to an improved system for lubricating an engine to insure against the draining of lubricant into the engine when the engine is not running and also to insure equal distribution of the lubricant.

A lubricating system has been proposed which has particular utility in conjunction with two cycle internal combustion engines wherein an engine driven pump pumps a fixed amount of lubricant during each cycle of its operation. The amount of lubricant actually supplied to the engine is controlled by a delivery valve that is solenoid operated and moveable between a delivery position wherein lubricant is delivered directly from the pump to the engine and a non-delivery position wherein the lubricant is pumped back to the system somewhere upstream of the inlet of the pump. The amount of lubricant supplied is adjusted by varying the duty cycle of the solenoid operated delivery valve. A system of this general type is disclosed in the co-pending application entitled "Lubricating Oil Supplying System For Two Cycle Engine", Ser. No. 862,984, filed Apr. 7, 1992 in the name of Yoshinobu Yashiro, which application is assigned to the Assignee hereof. The disclosure of that application is incorporated herein by reference.

Although this type of lubricating system is extremely effective in providing good lubrication control and, accordingly, minimizing the amount of emissions of smoke and other harmful constituents in the exhaust gases, there is some risk that when the engine is shut down, lubricant may flow to the engine past the delivery valve. This possibility exist because of the fact that lubricant normally flows from the lubricant tank to the pump by gravity and hence the tank is positioned at a higher level than the pump. Also, the provision of the return line to the supply valve gives rise to another flow path through which lubricant may leak back to the engine. If this leakage occurs, then the engine will emit smoke on initial starting and its exhaust gases will contain a high percentage of hydrocarbons.

It is, therefore, a principal object to this invention to provide an improved lubricating system of this type wherein leakage of lubricant to the engine when the engine is not running is avoided.

It is a further object to this invention to provide an improved lubricating system for an internal combustion engine of the type employing a delivery valve and in which the flow of lubricant past the delivery valve to the engine when the engine is not running is precluded.

In conjunction with lubricating system of this type, frequently the lubricant is delivered to the engine at more than one location. When this is done, frequently it is the practice to employ plural delivery valves, each controlling the amount of lubricant delivered to the respective lubrication point. When this is done, however, it is desirable to minimize the number of return conduits. However, if the return conduits are merged together, then the return from one delivery valve may upset or adversely affect the operation of the other delivery valve.

It is, therefore, a still further object to this invention to provide an improved lubricating system of the type employing plural delivery valves and wherein the flow restriction in the return lines for all delivery valves is substantially the same.

SUMMARY OF THE INVENTION

A first feature of this invention is adapted to be embodied in a lubricating system for an internal combustion engine comprising a lubricant tank for containing a lubricant. A lubricant pump has an inlet and an outlet and is employed for pumping lubricant. A first conduit supplies lubricant from the lubricant tank to the lubricant pump. A delivery valve is provided which is operable to direct lubricant from an inlet to either of a supply outlet or a return outlet for controlling the amount of lubricant supplied. A second conduit connects the lubricant pump outlet to the delivery valve inlet. A third conduit interconnects the delivery valve return outlet to a point in the system upstream of the lubricant pump inlet for returning lubricant that is pumped when the delivery valve is not in its delivery position. A fourth conduit connects the supply outlet of the delivery valve to the engine for its lubrication. In accordance with this feature of the invention, means are provided for precluding flow through at least one of the conduits when the engine is not running.

Another feature of the invention is adapted to be embodied in a lubricating system having a lubricant tank for containing a lubricant and a lubricant pump for pumping the lubricant. The lubricant pumped by the lubricant pump is delivered to at least a pair of delivery valves, each of which is operable to direct lubricant from the pump either to a supply outlet or a return outlet for controlling the amount of lubricant supplied to the engine. Conduit means extend from the return outlets of each of the delivery valves to the supply tank and the conduit means is sized so as to provide substantially the same flow resistance from each delivery valve to its return point.

DETAILED DESCRIPTION OF THE PREFERRED EMBODIMENTS OF THE INVENTION

Figure 1:
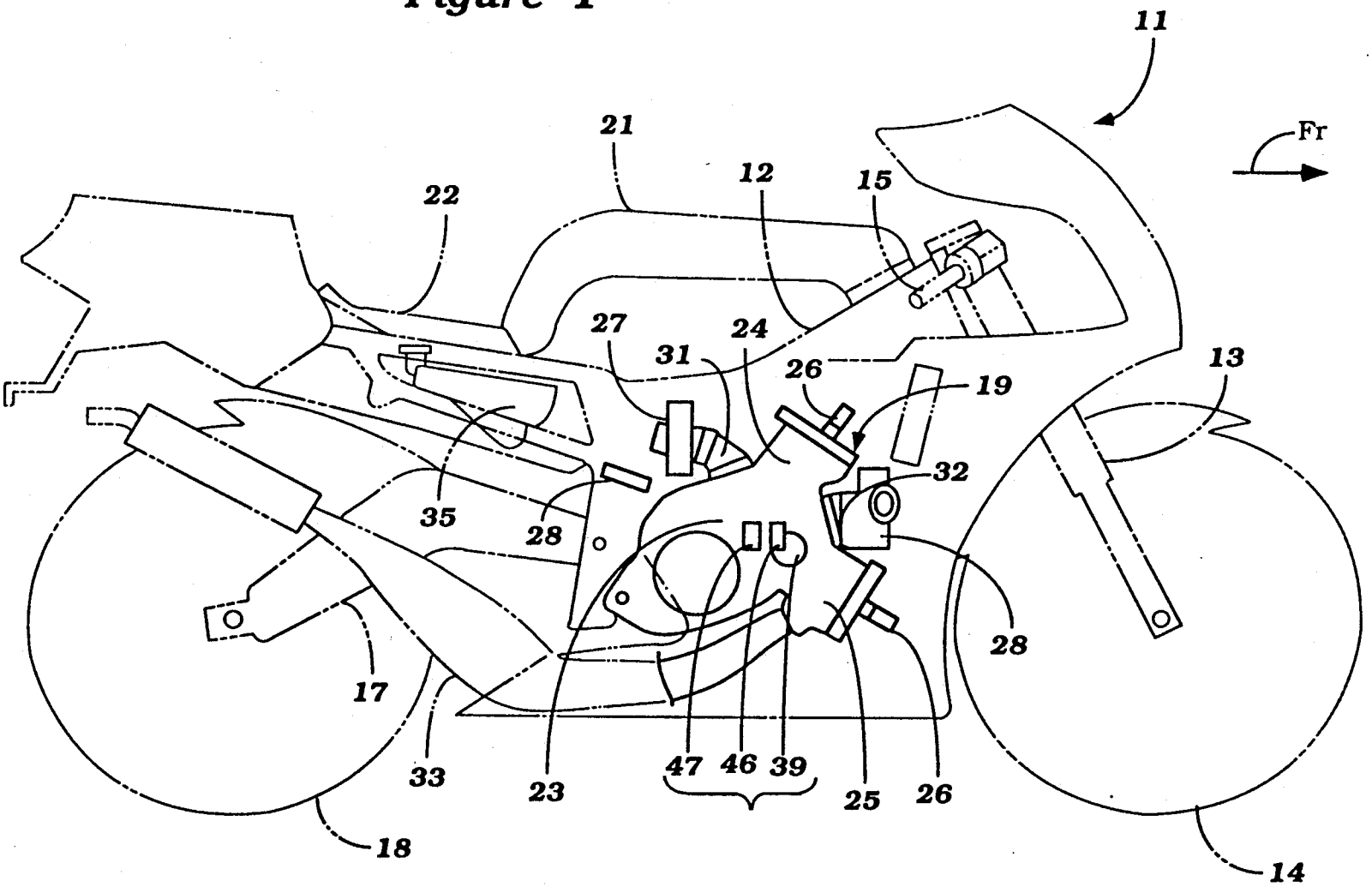
FIG. 1 is a side elevational view of a motorcycle powered by an internal combustion engine having a lubricating system constructed in accordance with an embodiment of the invention. The motorcycle is generally shown in phantom while the engine and its lubricating system are shown in solid lines.
Figure 2:
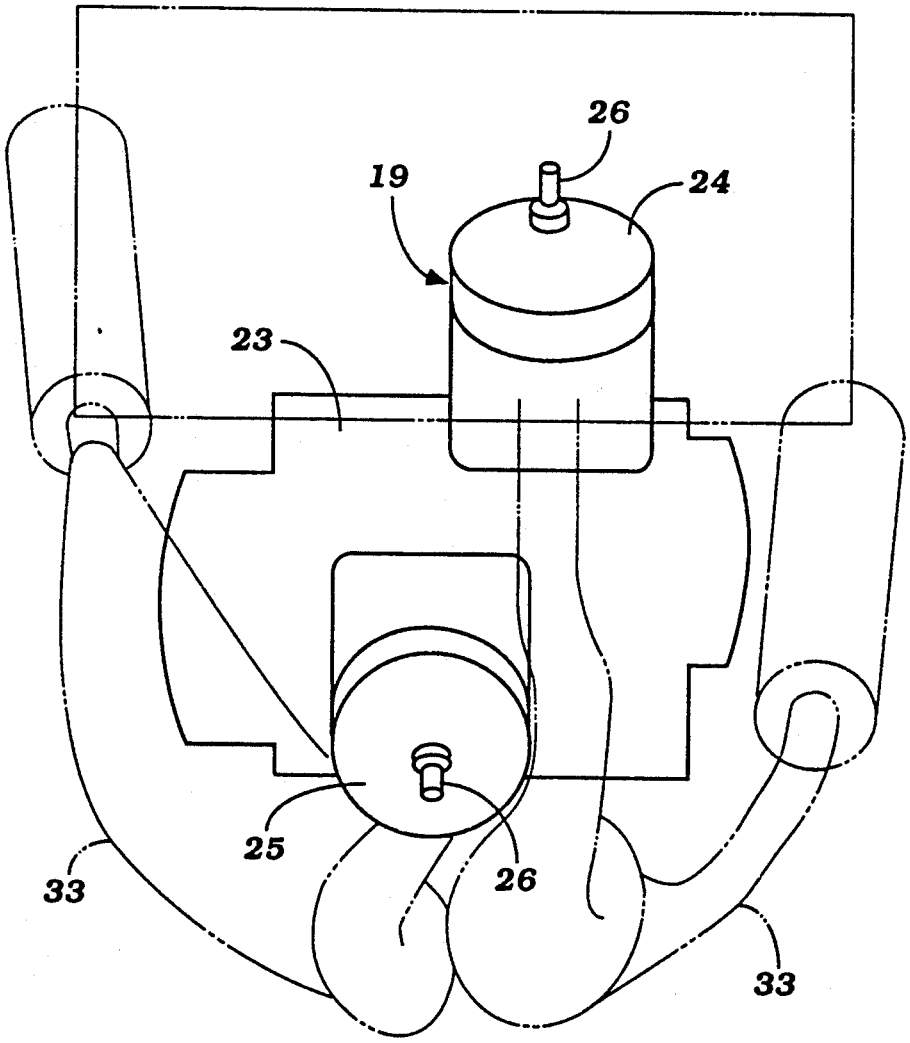
FIG. 2 is a front elevational view, on an enlarged scale, showing the engine and surrounding portions of the motorcycle.

Referring first to FIG. 1, a motorcycle is shown partially in phantom and is identified generally by the reference numeral 11. The motorcycle 11 is depicted primarily for orientation purposes inasmuch as the lubricating system may be used in conjunction with other applications for internal combustion engines. A motorcycle, however, is a typical environment in which the invention may be employed since it has particular utility with two cycle internal combustion engines and such engines are frequently employed for powering motorcycles.

The motorcycle 11 includes a frame assembly, indicated generally by the reference numeral 12 that dirigibly supports a front fork 13. The front fork 13 journals a front wheel 14 and is steered by means of a handlebar assembly 15 in a known manner. A trailing arm assembly 17 is journaled at the rear of the frame assembly 12 in a known manner and rotatably journals a rear wheel 18. The rear wheel 18 is driven by an internal combustion engine, indicated generally by the reference numeral 19, and which is mounted in the frame assembly 12 in a known manner.

A fuel tank 21 is carried by the frame assembly 12 above the engine 19 and supplies fuel to the engine 19 in a known manner. A seat 22 is mounted on the frame assembly 12 to the rear of the fuel tank 21 for accommodating a rider.

The engine 19 is, in the illustrated embodiment, of the V-2 two cycle, crankcase compression type. It is to be understood, however, that the invention may be employed with engines having other cylinder numbers or other configurations, engines operating on other than the two stroke principal and also rotary type engines.

The engine 19 includes a cylinder block assembly 23 having a pair of angularly disposed cylinder banks 24 and 25, each forming a cylinder bore. As is typical with motorcycle practice, the cylinder block 23 is mounted in the frame assembly 12 so that the output shaft rotates about a transversely extending axis. A suitable change speed transmission is incorporated within the crankcase of the cylinder block 23 and drives the rear wheel 18 in any suitable manner. Cylinder heads are affixed to the cylinder banks 24 and 25 and each mount respective spark plugs 26 for firing the charge which is delivered to the combustion chambers of the engine in a well known manner.

Figure 3:
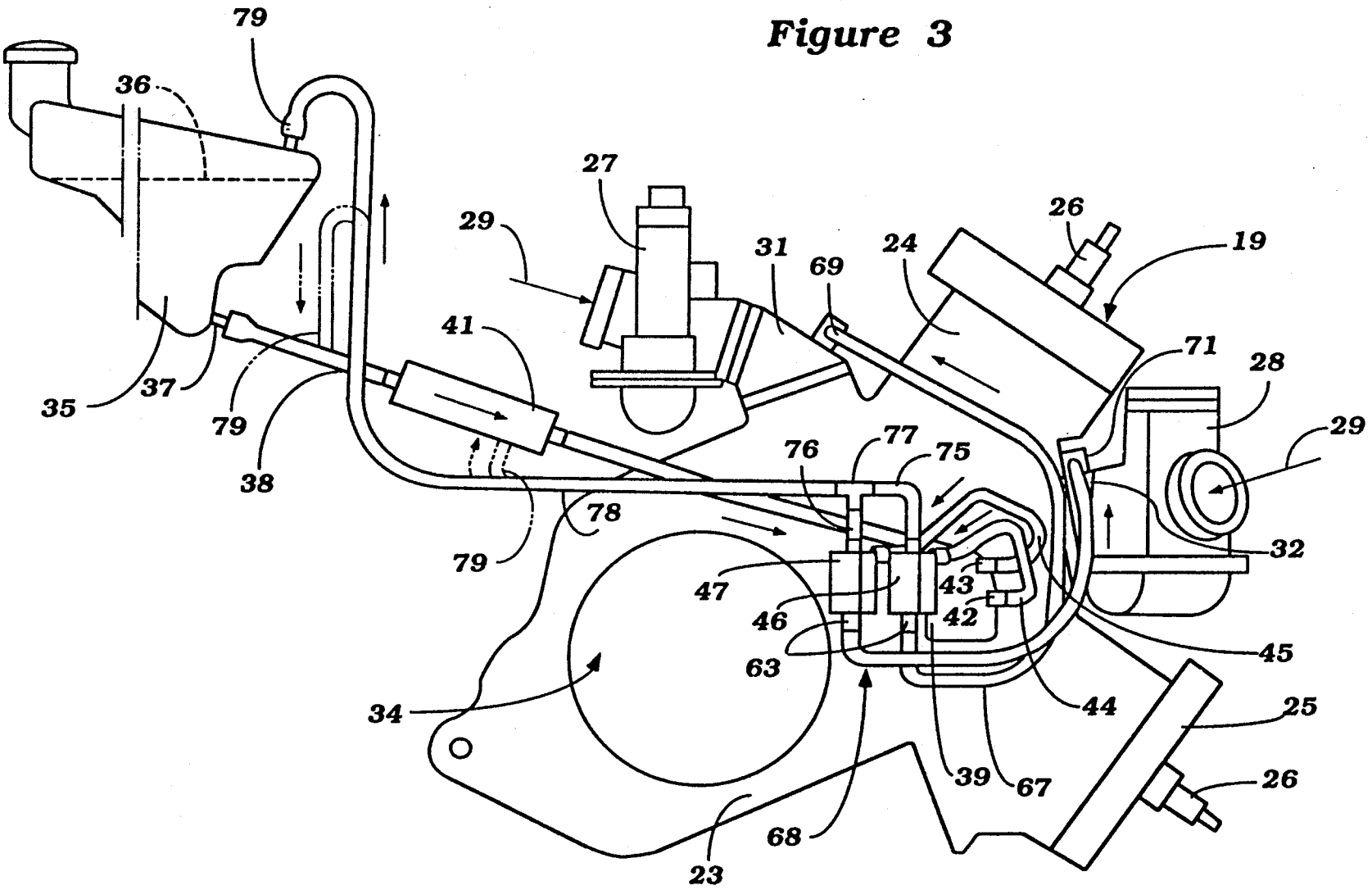
FIG. 3 is an enlarged side elevational view, in part similar to FIG. 1, and shows only the engine and the lubricating system.

The induction system includes a pair of carburetors 27 and 28 which draw air through an air cleaner system, as shown schematically by the arrows 29 in FIG. 3. The carburetors 27 and 28 discharge into the crankcase chambers associated with the individual cylinder banks 24 and 25 through respective intake manifolds 31 and 32.

In connection with the orientation of the engine 19, the front and rear sides of the engine are related to the front and rear of the motorcycle 11 with the front indicated by the arrow Fr. In addition to the front and rear sides, the engine 19 has a top side, a bottom side, a left hand side and a right hand side, all oriented relative to the body of the motorcycle 11. As used in the claims "sides" may be any of such sides.

A pair of exhaust, pipes and muffler arrangements 33 extend from the exhaust ports of the respective cylinder banks 24 and 25 on opposite sides of the motorcycle 11 and discharge exhaust gases to the atmosphere in a well known manner.

No details of the internal construction of the engine 19 have been illustrated nor is any further description of the basic construction of the engine 19 believed to be necessary to permit those skilled in the art to understand the construction and operation of the invention, which relates primarily to the lubricating system for the engine 19. This lubricating system is indicated generally by the reference numeral 34 and will now be described in greater detail by particular reference initially to FIGS. 1 and 3.

The lubricating system 34 includes a lubricant tank 35 that is mounted at the rear of the frame assembly 12 at an elevated position. The lubricant tank 35 contains lubricant at a level indicated by the broken line 36 in FIG. 3 which, it should be noted, lies above the upper level of the engine 19.

An outlet nipple 37 of the lubricant tank 35 is connected to a first conduit 38 for gravity delivery of lubricant from the tank 35 to a lubricating pump, indicated generally by the reference numeral 39 and mounted at one side of the engine (the right hand side in the illustrated embodiment). An oil filter 41 is provided in the first conduit 38 for filtering the lubricant before it is delivered to the lubricant pump 39.

The lubricant pump 39 may be a conventional reciprocating type pump that is driven by the engine in a suitable manner. The pump 39 has a pair of outlet fittings 42 and 43 to which one end of second conduits 44 and 45 are affixed. The opposite ends of the conduits 44 and 45 are connected to inlet fittings of respective delivery valves 46 and 47, each having a construction as shown in FIG. 4.

Figure 4:
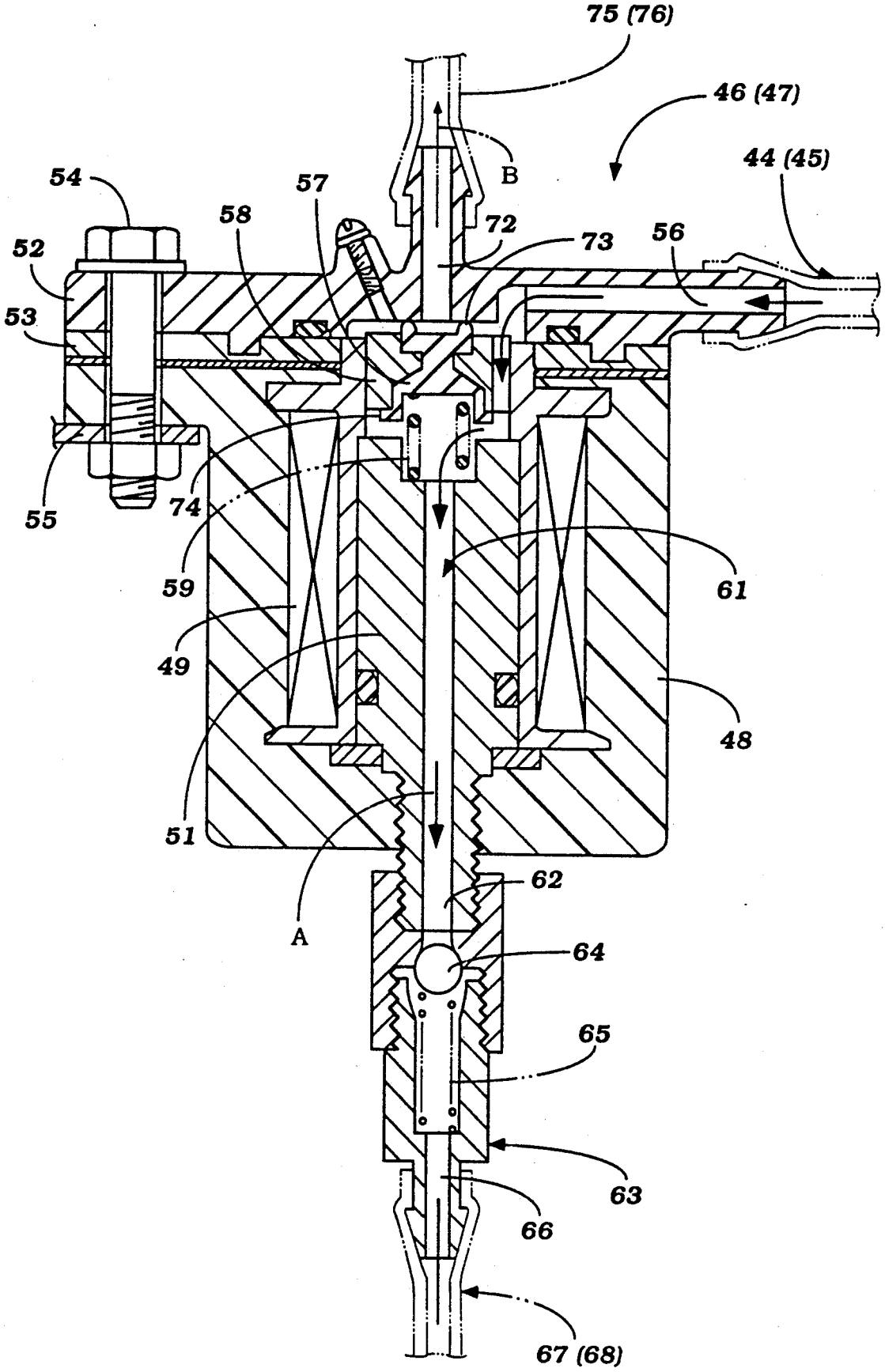
FIG. 4 is an enlarged cross sectional view taken through one of the delivery valves.

Referring specifically to FIG. 4, the delivery valves 46 and 47 each are comprised of an outer housing 48 having an internal cavity in which a solenoid winding 49 is provided. The winding 49 encircles a core 51. This cavity is closed by means of a cover plate 52 that is affixed to an outwardly extending flange of the outer housing 48 with an interposed gasket 53 by means of threaded fasteners 54. The fasteners 54 also secure the delivery valves 46 and 47 to the side of the engine 19 and specifically the cylinder block 23 closely adjacent the lubricant pump 39 so as to minimize the length of the conduits 44 and 45. A mounting bracket 55 is affixed to the cylinder block 23 for mounting purposes.

An inlet passage 56 is formed in the cover plate 52 and receives the ends of the respective conduits 44 and 45 so as to permit lubricant to flow under pressure from the pump 39 into an internal cavity 57 formed within the cover plate 52. A slideably supported valve member 58 is mounted in the core 51 and has a ferromagnetic portion that is operated on by the winding 49 so as to effect a changing flow path from the lubricant pump 39.

A coil compression spring 59 normally urges the valve member 58 upwardly and opens communication with a delivery passage 61 formed centrally in the core 51 and which has an outlet fitting 62 formed at its lower end. A check valve 63 is connected to the outlet fitting 62 and functions to permit flow from the passage 61 to the engine, in a manner to be described, while precluding flow in the opposite direction. In addition, the check valve 63 will function to prevent any drainage of lubricant when the engine 19 is not running.

The check valve 63 includes a ball type valve member 64 which is urged by a coil compression spring 65 to a normally closed position. When the pressure is exerted in the passage 61, the ball valve member 64 will be urged downwardly against the action of the coil spring 65 and lubricant may flow from a discharge fitting 66 to the engine through conduits 67 and 68.

The conduits 67 and 68, as may be best seen in FIG. 3, extend to lubricant discharges 69 and 71, respectively, which are tapped into the intake manifolds 31 and 32. Although in the illustrated system there is one lubricant fitting 69 and 71 for each intake manifold 31 and 32, it is to be understood that various other ways of delivering the lubricant to the engine 19 other than through its intake manifolds may be employed in conjunction with the invention. It is important, however, to note that the fittings 69 and 71 are positioned at a higher level than the outlet of the discharge fittings 66 from the delivery valves 46 and 47. This insures that lubricant also will not drain from the delivery valves 46 and 47 to the engine when the engine is not running. In addition, by providing the supply outlet fitting 6 at the lower portion of the delivery valves 46 and 47, it will be insured that air is less likely to flow through the delivery valves 46 and 47 to the engine.

Returning again to FIG. 4, a return passage 72 is formed in the cover plate 52 and communicates with the chamber 57. The return passage 72 is normally closed by a seal 73 of the valve member 58 when the valve member 58 is in the position shown in FIG. 4. However, when the solenoid winding 49 is energized, a seal portion 74 will engage and close the passage 61 while opening the return passage 72. Lubricant is then returned to the lubricant tank 35 through a pair of return conduits 75 and 76 which merge at a T-connection 77. The T-connection 77 is connected to a conduit 78 which extends back to a return fitting 79 of the lubricant tank 35 positioned above the normal lubricant level therein. Because of this elevated orientation, air which may be entrapped in the lubricant will flow by gravity upwardly and be collected in the chambers 58 for return along with the lubricant to the tank 35 during the non-delivery portion of the cycle.

It is desirable to insure that the return paths from each of the delivery valves 46 and 47 has substantially the same flow resistance. This will insure equal flow when the delivery valves are in either position and will prevent any irregularities in the amount of lubricant supplied to the engine 19. Therefore, the conduits 75 and 76 are configured to have the same effective cross sectional flow area and substantially the same length. Rather than use a T-connection as the connection 77, a Y-connection may also be employed and this will provide even greater balancing in the flow resistance in the two return paths.

As described in the aforenoted co-pending application Ser. No. 862,984, the amount of lubricant delivered to the engine is controlled by varying the duty cycle and time when the solenoid winding 49 is energized.

In the embodiment as thus far described, the return lubricant has been returned directly to the tank 35. It is to be understood, however, that the lubricant may be returned anywhere to the system but preferably upstream of the filter 41. Flow may be returned either to the conduit 37 upstream of the filter 41 as shown by the alternative location 79' or to the upstream side of the filter element 41 as shown by the phantom line position 79'' in FIG. 3.

Figure 5:
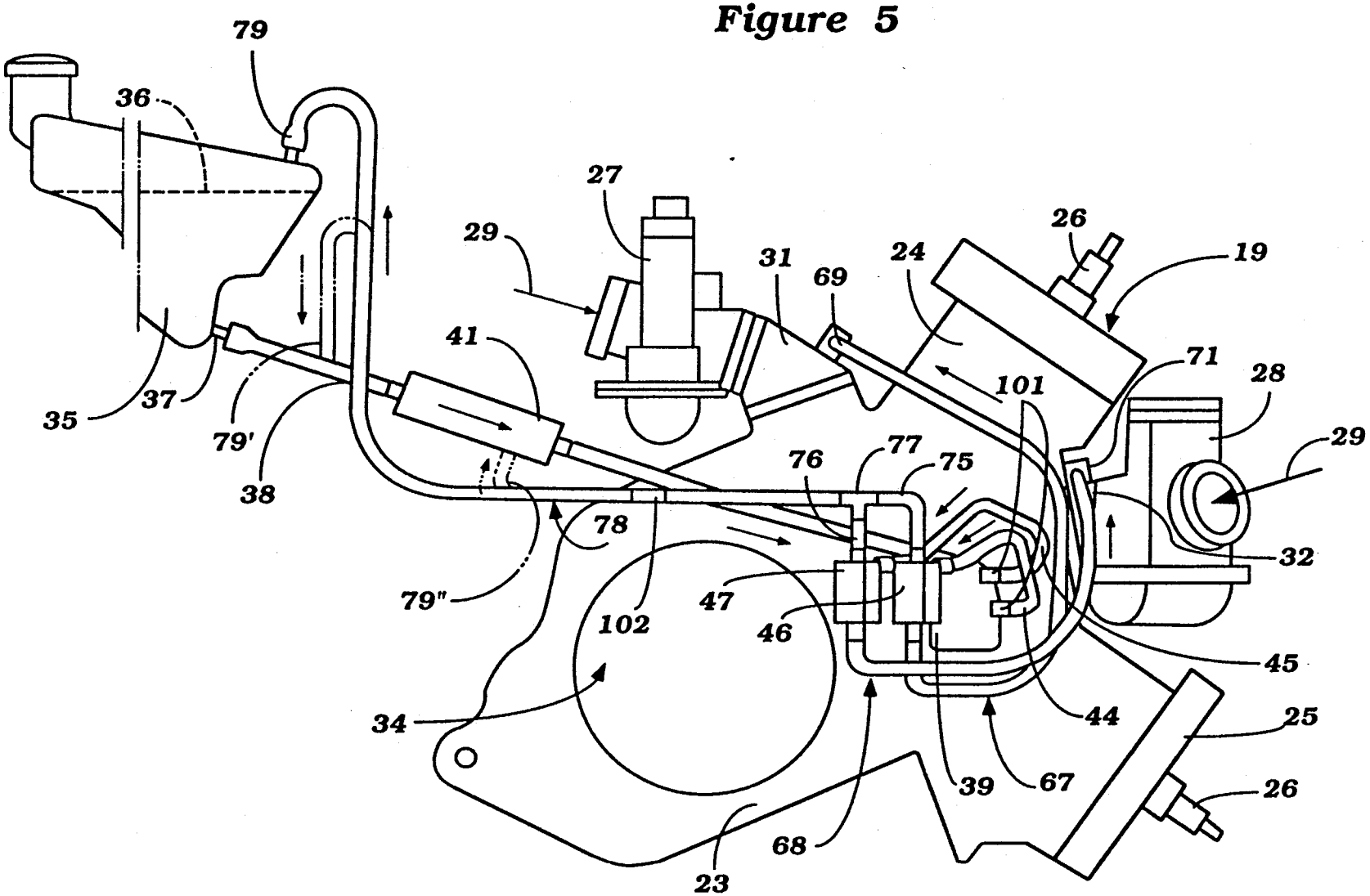
FIG. 5 is a side elevational view, in part similar to FIG. 3 and shows another embodiment of the invention.

In the embodiments of the invention as thus far described, the check valves 63 have been positioned in the supply outlet fittings 62 of the delivery valves 46 and 47. With such an arrangement, flow from the delivery valves 46 and 47 to the engine 19 when the engine 19 is not running will be precluded. In some instance, it may be desirable to locate the check valves at a different location and FIG. 5 shows such an arrangement. Except for the locations of the check valves in this embodiment, all of the elements of the system are the same as that of the embodiment previously described and, for that reason, those elements will not be described again, except insofar as how they relate to this embodiment.

In this embodiment, there are no check valves in the supply outlet fittings 62 of the delivery valves 46 and 47. Rather, there are provided a pair of check valves 101 in the outlet from the pump 39 where it enters the conduits 44 and 45. The check valves 101 normally permit flow from the pump 39 into the lines 44 and 45 but preclude reverse flow. Also, when the pump 39 is not operating due to the fact that the engine 19 is not running, the check valves 101 will preclude any leakage of fluid past the pump 39 into the engine.

In the previously described embodiment, the location of the check valve 63 was such so as to preclude any leakage from the return line 78 back to the engine through the delivery valves 46 and 47. To prevent such return flow in this embodiment, a further check valve 102 is provided in the return line 78 at an appropriate location, and primarily downstream from the T or Y fitting 77. The check valve 102 will permit pressurized flow of lubricant back to the tank 35 through the line 78 but will preclude flow in the opposite direction as might occur when the engine is shut off.

It should be readily apparent from the foregoing description that the described systems are extremely effective in insuring good supply of lubricant to the engine when it is running and at the same time precluding any leakage of lubricant to the engine when it is shut down. In addition, the system also provides an arrangement whereby multiple delivery valves may be employed for controlling lubrication delivery to various points in the engine and wherein the return systems for these multiple delivery valves is such that the flow resistance in a return line from all delivery valves will be substantially the same. Of course, the preceding description is that of preferred embodiments of the invention and various changes and modifications may be made without departing from the spirit and scope of invention, as defined by the appended claims.

I claim:

1. A lubricating system for an internal combustion engine comprising a lubricant tank for containing a lubricant, a lubricant pump having an inlet and an outlet for pumping lubricant, a first conduit for supplying lubricant from said lubricant tank to said lubricant pump inlet, a delivery valve operable to direct lubricant from an inlet to either of a supply outlet or a return outlet for controlling the amount of lubricant supplied, a second conduit connecting said lubricant pump outlet to said delivery valve inlet, a third conduit for returning lubricant from said return outlet of said delivery valve to a point in said system upstream of said lubricant pump inlet, and a fourth conduit connecting said supply outlet of said delivery valve to said engine for its lubrication, and a check valve in said fourth conduit for precluding flow through said fourth conduit when said engine is not running.

2. A lubricating system as set forth in claim 1 further including check valve means in the third conduit for permitting flow from the delivery valve while precluding flow to the delivery valve.

3. A lubricating system as set forth in claim 1 further including a second delivery valve having an inlet, a supply outlet and a return outlet, a fifth conduit interconnecting said supply outlet of said second delivery valve with the engine for its lubrication and a sixth conduit for connecting said return outlet of said second delivery valve for returning liquid from said second delivery valve to a point in the system upstream of said lubricant pump.

4. A lubricating system for an internal combustion engine comprising a lubricant tank for containing a lubricant, a lubricant pump having an inlet and an outlet for pumping lubricant, a first conduit for supplying lubricant from said lubricant tank to said lubricant pump inlet, a delivery valve operable to direct lubricant from an inlet to either of a supply outlet or a return outlet for controlling the amount of lubricant supplied, a second conduit connecting said lubricant pump outlet to said delivery valve inlet, a third conduit for returning lubricant from said return outlet of said delivery valve to a point in said system upstream of said lubricant pump inlet, and a fourth conduit connecting said supply outlet of said delivery valve to said engine for its lubrication, means for precluding flow through at least one of said conduits when said engine is not running, a second delivery valve having an inlet, a supply outlet and a return outlet, a fifth conduit interconnecting said supply outlet of said second delivery valve with the engine for its lubrication and a sixth conduit for connecting said return outlet of said second delivery valve for returning liquid from said second delivery valve to a point in the system upstream of said lubricant pump, the flow resistance of said third and said sixth conduit being substantially equal.

5. A lubricating system as set forth in claim 4 wherein the third and sixth conduits are connected to each other through a common fitting and return fluid to the system at a common point, the third and sixth conduits having substantially the same cross sectional area and length.

6. A lubricating system as set forth in claim 4 wherein a check valve means is positioned between the lubricant pump and the point of delivery of the lubricant to the engine.

7. A lubricating system as set forth in claim 6 wherein the check valve means is provided in the second and fifth conduits.

8. A lubricating system as set forth in claim 7 further including check valve means in the third and sixth conduits for permitting flow from the delivery valves while precluding flow to the delivery valves.

9. A lubricating system for an internal combustion engine comprising a lubricant tank for containing a lubricant, a lubricant pump having an inlet receiving lubricant from said lubricant tank, an outlet and means for pumping lubricant from said inlet to said outlet, first and second delivery valves each having a respective inlet, a supply outlet, a return outlet and means for controlling the communication of said delivery valve inlet with said supply outlet and said return outlet for controlling the amount of lubricant delivered to the engine, first and second conduit means for delivering lubricant from the respective supply outlets of said delivery valves to respective points in the engine, third and fourth conduits for connecting said return outlets of said delivery valves with a point in the system upstream of the inlet of said lubricant pump, and said third and said fourth conduits having substantially equal flow resistance.

10. A lubricating system as set forth in claim 9 wherein the third and forth conduits meet at a common connection to a fifth conduit which connects the third and fourth conduits to the system upstream of the inlet to the lubricant pump.

11. A lubricating system as set forth in claim 10 wherein the third and fourth conduits have substantially the same cross sectional area and length.

* * * * *